US010835784B1

(12) United States Patent
Williams et al.

(10) Patent No.: US 10,835,784 B1
(45) Date of Patent: Nov. 17, 2020

(54) PERSONAL PROPULSION DEVICE

(71) Applicants: Jeffrey Williams, La Habra, CA (US); Corina Williams, La Habra, CA (US)

(72) Inventors: Jeffrey Williams, La Habra, CA (US); Corina Williams, La Habra, CA (US)

( * ) Notice: Subject to any disclaimer, the term of this patent is extended or adjusted under 35 U.S.C. 154(b) by 0 days.

(21) Appl. No.: 16/413,031

(22) Filed: May 15, 2019

(51) Int. Cl.
*A63B 35/12* (2006.01)

(52) U.S. Cl.
CPC ..... *A63B 35/12* (2013.01)

(58) Field of Classification Search
CPC ..... A63B 35/12
See application file for complete search history.

(56) References Cited

U.S. PATENT DOCUMENTS

| | | | | | |
|---|---|---|---|---|---|
| 3,441,952 | A * | 4/1969 | Strader | A63B 35/12 | 440/6 |
| 3,635,188 | A * | 1/1972 | Rutkowski | A63B 35/12 | 440/6 |
| 3,757,721 | A * | 9/1973 | Ohishi | A63B 35/12 | 114/315 |
| 4,700,654 | A * | 10/1987 | Borges | A63B 35/12 | 114/338 |
| 4,938,722 | A * | 7/1990 | Rizley | B63H 20/007 | 440/6 |
| 4,996,938 | A * | 3/1991 | Cameron | A63B 35/12 | 114/315 |
| 5,024,178 | A * | 6/1991 | Bruce | A63B 35/12 | 114/315 |
| 5,105,753 | A * | 4/1992 | Chih | A63B 35/12 | 114/315 |
| 5,947,782 | A * | 9/1999 | Siladke | B63H 23/24 | 441/129 |
| 6,036,555 | A * | 3/2000 | Takacs | B63H 21/17 | 440/6 |
| 6,572,422 | B2 * | 6/2003 | Kirkwood | B63G 8/08 | 114/312 |
| 8,651,041 | B2 * | 2/2014 | Myers | B63C 11/46 | 114/315 |
| 9,327,165 | B2 * | 5/2016 | Melendez | A63B 35/12 | |
| 10,363,456 | B2 * | 7/2019 | Melendez | A63B 35/12 | |
| 10,398,940 | B2 * | 9/2019 | Grosse Austing | A63B 35/12 | |
| 2015/0047548 | A1 * | 2/2015 | Mazin | B63C 11/46 | 114/315 |

* cited by examiner

*Primary Examiner* — S. Joseph Morano
*Assistant Examiner* — Jovon E Hayes

(57) ABSTRACT

A personal propulsion device for use with a floatation device includes a pair of propulsion units. Each propulsion unit comprises a power module, a motor, and a propeller. The motor is operationally coupled to the power module and the propeller so that the motor is positioned to selectively rotate the propeller to impart a force on water. Each propulsion unit is configured to be grasped in a respective hand of a user who is positioned on a floatation device. The user is positioned to submerge the propulsion unit in a body of water so that the floatation device is motivated across a surface of the body of water.

17 Claims, 4 Drawing Sheets

PERSONAL PROPULSION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to propulsion devices and more particularly pertain to a new propulsion device for use with a floatation device.

BRIEF SUMMARY OF THE INVENTION

An embodiment of the disclosure meets the needs presented above by generally comprising a pair of propulsion units. Each propulsion unit comprises a power module, a motor, and a propeller. The motor is operationally coupled to the power module and the propeller so that the motor is positioned to selectively rotate the propeller to impart a force on water. Each propulsion unit is configured to be grasped in a respective hand of a user who is positioned on a floatation device. The user is positioned to submerge the propulsion unit in a body of water so that the floatation device is motivated across a surface of the body of water.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
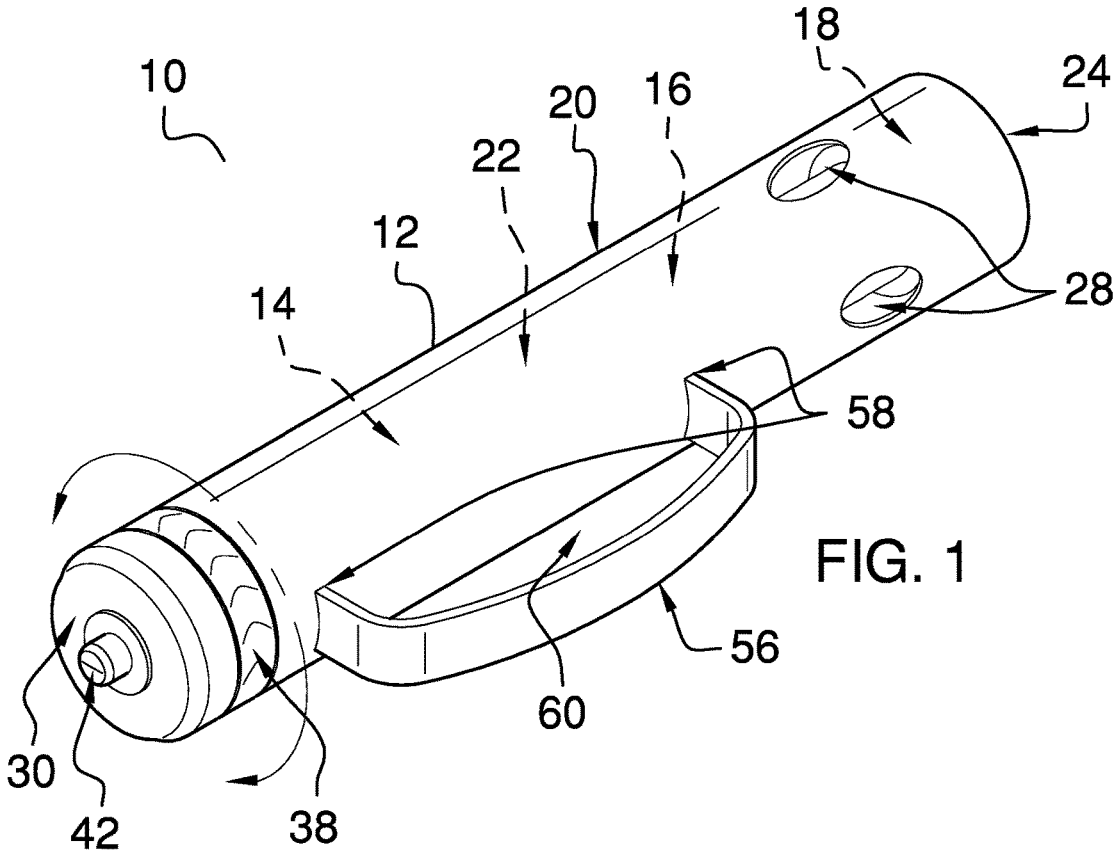
FIG. 1 is an isometric perspective view of a personal propulsion device according to an embodiment of the disclosure.

With reference now to the drawings, and in particular to FIGS. 1 through 6 thereof, a new propulsion device embodying the principles and concepts of an embodiment of the disclosure and generally designated by the reference numeral 10 will be described.

Figure 3:
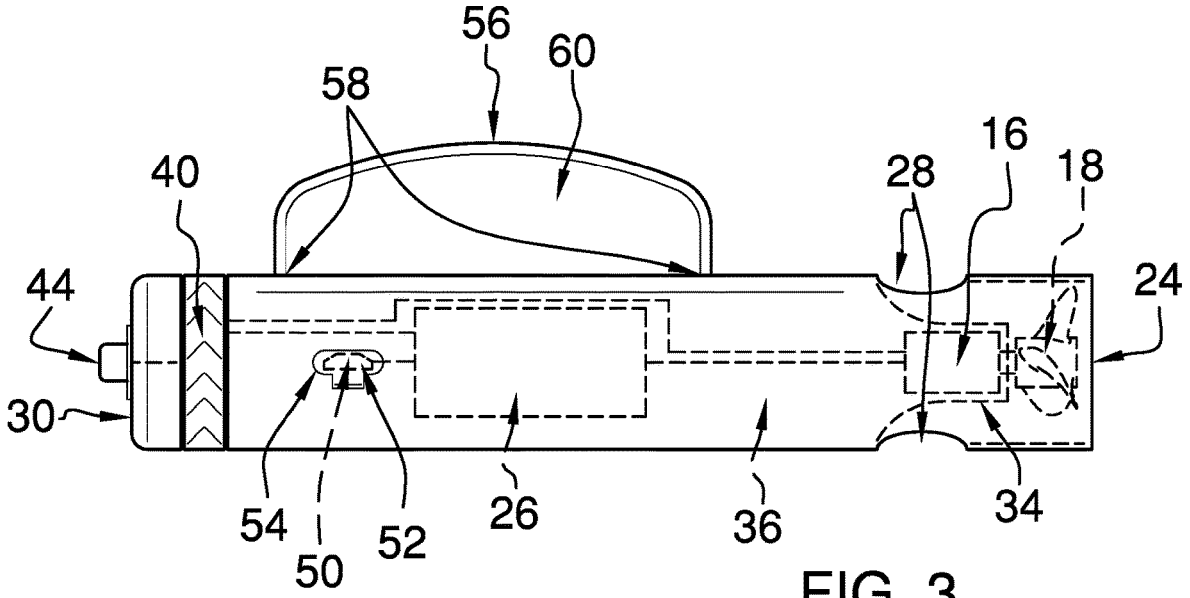
FIG. 3 is a side view of an embodiment of the disclosure.
Figure 4:
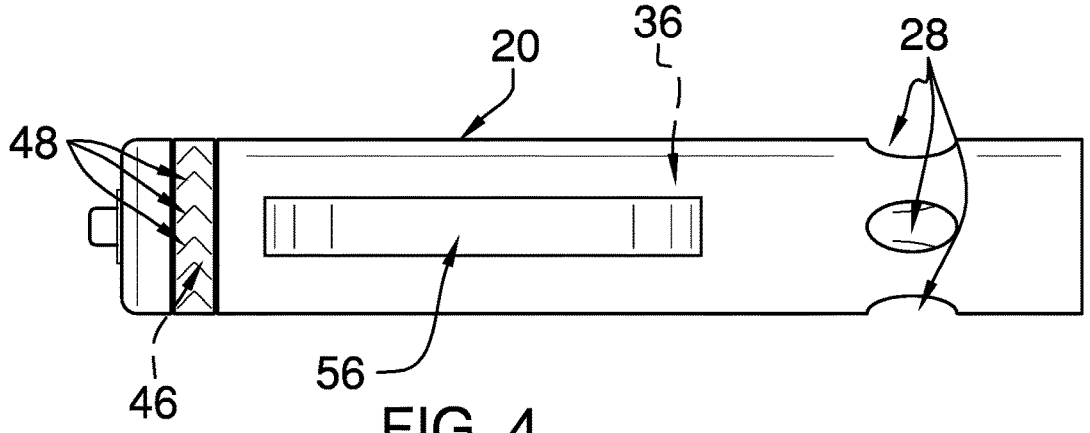
FIG. 4 is a top view of an embodiment of the disclosure.
Figure 5:
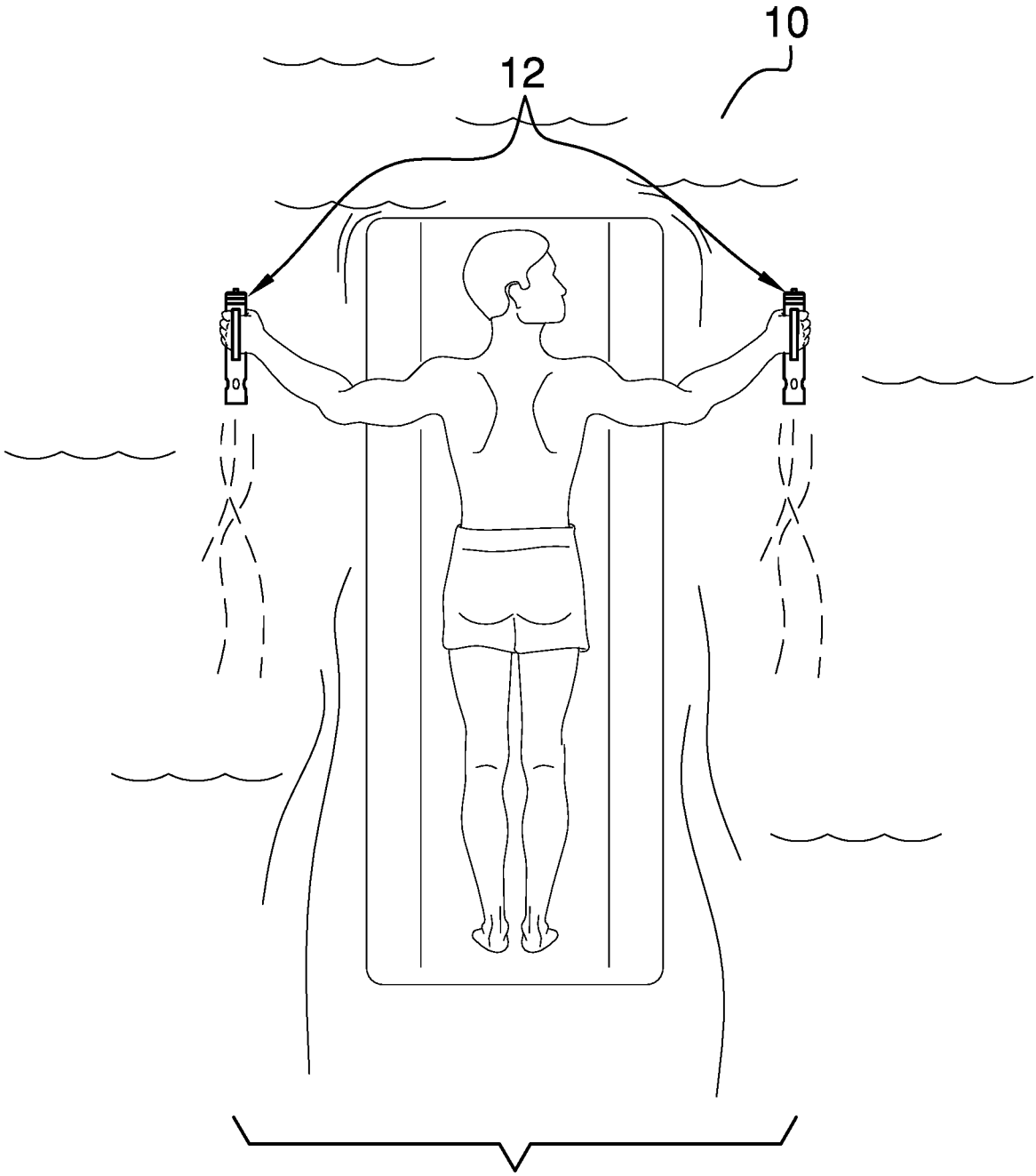
FIG. 5 is an in-use view of an embodiment of the disclosure.

As best illustrated in FIGS. 1 through 6, the personal propulsion device 10 generally comprises a pair of propulsion units 12. Each propulsion unit 12 comprises a power module 14, a motor 16, and a propeller 18. The motor 16 is operationally coupled to the power module 14 and the propeller 18 so that the motor 16 is positioned to selectively rotate the propeller 18 to impart a force on water. Each propulsion unit 12 is configured to be grasped in a respective hand of a user who is positioned on a floatation device, such as a raft, a mattress, a tube, or the like. The user is positioned to submerge the propulsion unit 12 in a body of water so that the floatation device is motivated across a surface of the body of water, as shown in FIG. 5.

Each propulsion unit 12 comprises a housing 20 that defines an interior space 22. The power module 14 and the motor 16 are coupled to the housing 20 and are positioned in the interior space 22. The propeller 18 is rotationally coupled to the housing 20 and is positioned in the interior space 22 proximate to a first end 24 of the housing 20, which is open. The housing 20 is cylindrically shaped. The power module 14 comprises a battery 26 that is rechargeable.

A plurality of apertures 28 is positioned in the housing 20 between the propeller 18 and a second end 30 of the housing 20, as shown in FIG. 4. The apertures 28 are configured to allow inflow of water into the interior space 22, positioning the propeller 18 to expel the water through the first end 24 of the housing 20 to impart the force on the water to motivate the floatation device across the surface of the body of water. The apertures 28 are ovally shaped. The plurality of apertures 28 comprises from three to six apertures 28. The plurality of apertures 28 comprises four apertures 28.

Figure 2:
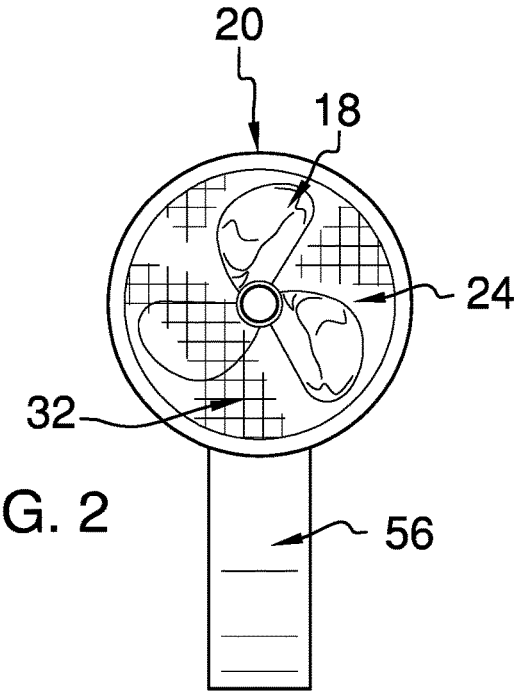
FIG. 2 is a rear view of an embodiment of the disclosure.

A grate 32 is coupled to the housing 20 and extends over the first end 24 of the housing 20, as shown in FIG. 2. The grate 32 is configured to shield the propeller 18. The grate 32 serves to prevent injury to a person caused by inserting a body part into the first end 24 of the housing 20 and contacting of the body part the propeller 18.

A wall 34 is coupled to the housing 20 and is positioned in the interior space 22 to define a chamber 36, as shown in FIG. 3. The wall 34 is positioned proximate to the plurality of apertures 28 so that water that enters the interior space 22 through the apertures 28 is directed along the wall 34 to the propeller 18. The power module 14 is substantially centrally positioned in the chamber 36. The motor 16 is positioned in the chamber 36 proximate to the wall 34. The chamber 36 is watertight so that the power module 14 and the motor 16 are protected from water damage. The motor 16 is magnetically coupled to the propeller 18.

A controller 38 that is coupled to the housing 20 is operationally coupled to the motor 16 so that the controller 38 is positioned to control a rotational speed of the propeller 18 to adjust the force imparted on the water by the propeller 18. The controller 38 comprises a ring 40 that is rotationally coupled to the housing 20 proximate to the second end 30, as shown in FIG. 1. The ring 40 is configured to be selectively rotated relative to the housing 20 to control the rotational speed of the propeller 18 to adjust the force imparted on the water by the propeller 18.

A switch 42 that is coupled to the second end 30 of the housing 20 is operationally coupled to the motor 16 and the power module 14. The switch 42 is configured to be selectively switched to operationally couple the power module 14 to the motor 16. The switch 42 comprises a button 44, which is depressible. The button 44 is configured to be depressed a first time to operationally couple the power module 14 to the motor 16 and to be depressed a second time to decouple the power module 14 from the motor 16.

A recess 46 is positioned in the housing 20 proximate to the second end 30. The ring 40 is positioned in the recess 46 so that the ring 40 is substantially flush to an exterior surface of the housing 20. A plurality of indentations 48 is positioned in the ring 40. The indentations 48 are configured to prevent slippage of digits of the respective hand of the user positioned upon the ring 40 to rotate the ring 40 relative to the housing 20.

A connector 50 that is coupled to the housing 20 is operationally coupled to the battery 26, as shown in FIG. 3. The connector 50 is configured to insert a plug of a charging cord (not shown) to recharge the battery 26. The connector 50 comprises a Universal Serial Bus port 52.

A stopper 54 is hingedly coupled to the housing 20 proximate to the Universal Serial Bus port 52. The stopper 54 is complementary to the Universal Serial Bus port 52 so that the stopper 54 is positioned to be selectively inserted into the Universal Serial Bus port 52. The stopper 54 is configured to seal the Universal Serial Bus port 52 to prevent entry of water through the Universal Serial Bus port 52 into the chamber 36.

Figure 6:
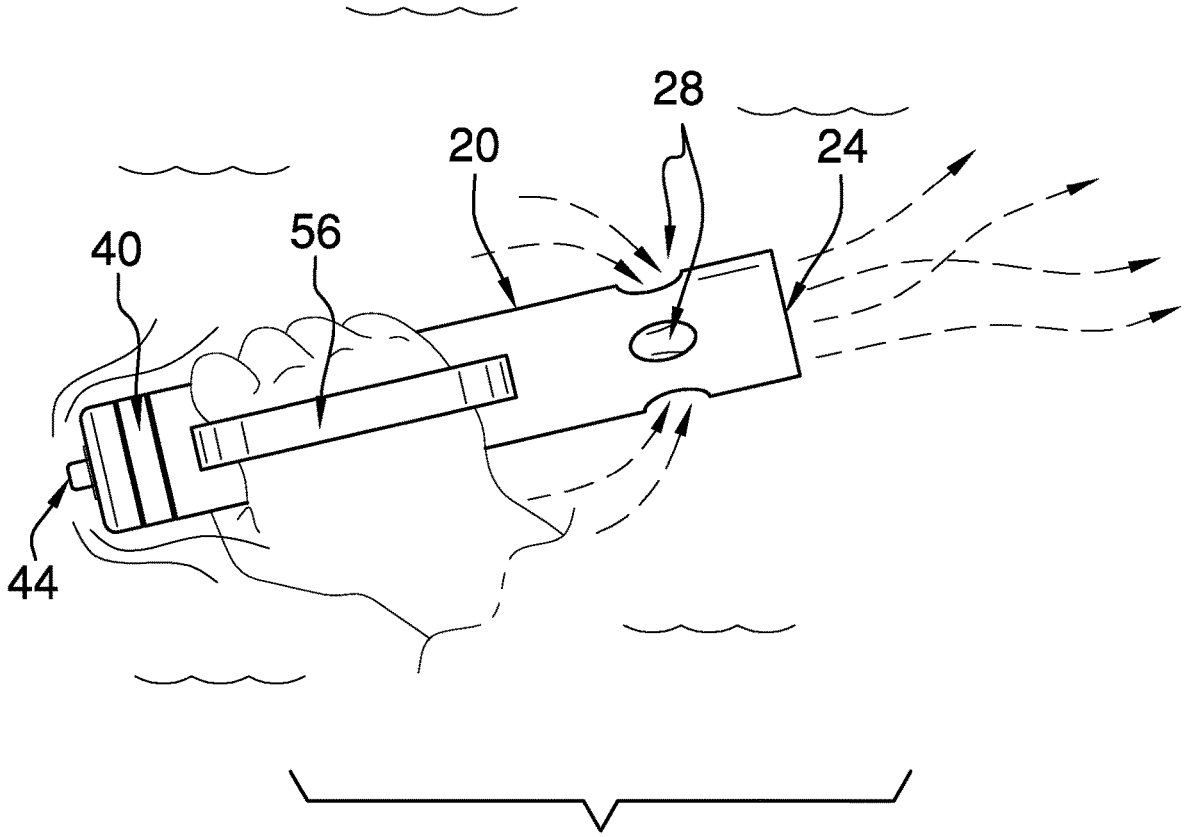
FIG. 6 is a detail view of an embodiment of the disclosure.

Each of a pair of straps 56 has opposing ends 58 that are coupled to a respective housing 20 to define a loop 60. The loop 60 is configured to insert the respective hand of the user so that the housing 20 is loopedly coupled to the respective hand of the user, as shown in FIG. 6. The straps 56 help the user retain control of the propulsion units 12.

In use, the button 44 on the housing 20 is depressed to actuate the motor 16 to rotate the propeller 18. The speed of rotation of the propeller 18 is adjusted to a desired rate by rotating the ring 40 relative to the housing 20. The user then submerges the housing 20 in the water. Water entering the interior space 22 through the apertures 28 is expelled by the propeller 18. The force imparted on the water by the propeller 18 motivates the floatation device across the surface of the body of water.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A personal propulsion device comprising:

a pair of propulsion units, each propulsion unit comprising a power module, a motor, and a propeller, the motor being operationally coupled to the power module and the propeller such that the motor is positioned for selectively rotating the propeller for imparting a force on water wherein each propulsion unit is configured for grasping in a respective hand of a user positioned on a floatation device positioning the user for submerging the propulsion unit in a body of water such that the floatation device is motivated across a surface of the body of water, each propulsion unit comprising:

a housing defining an interior space, the power module and the motor being coupled to the housing and positioned in the interior space, the propeller being rotationally coupled to the housing and positioned in the interior space proximate to a first end of the housing, the first end being open, a plurality of apertures positioned in the housing between the propeller and a second end of the housing wherein the apertures are configured for inflow of water into the interior space positioning the propeller for expelling the water through the first end of the housing for imparting the force on the water for motivating the floatation device across the surface of the body of water, and a controller coupled to the housing, the controller being operationally coupled to the motor such that the controller is positioned for controlling a rotational speed of the propeller for adjusting the force imparted on the water by the propeller, the controller comprising a ring rotationally coupled to the housing proximate to the second end wherein the ring is configured being selectively rotated relative to the housing for controlling the rotational speed of the propeller for adjusting the force imparted on the water by the propeller.

2. The device of claim 1, further including the housing being cylindrically shaped.

3. The device of claim 1, further including the apertures being ovally shaped.

4. The device of claim 1, further including the plurality of apertures comprising from three to six apertures.

5. The device of claim 4, further including the plurality of apertures comprising four apertures.

6. The device of claim 1, further including a grate coupled to the housing and extending over the first end of the housing wherein the grate is configured for shielding the propeller.

7. The device of claim 1, further including a wall coupled to the housing and positioned in the interior space defining a chamber, the wall being positioned proximate to the plurality of apertures such that water entering the interior space through the apertures is directed along the wall to the propeller, the power module being substantially centrally positioned in the chamber, the motor being positioned in the chamber proximate to the wall.

8. The device of claim 7, further comprising:

the chamber being watertight such that the power module and the motor are protected from water damage; and the motor being magnetically coupled to the propeller.

9. The device of claim 1, further including a switch coupled to the second end of the housing, the switch being operationally coupled to the motor and the power module wherein the switch is configured for being selectively switched for operationally coupling the power module to the motor.

10. The device of claim 9, further including the switch comprising a button, the button being depressible wherein the button is configured for being depressed a first time for operationally coupling the power module to the motor and for being depressed a second time for decoupling the power module from the motor.

11. The device of claim 1, further including a recess positioned in the housing proximate to the second end, the ring being positioned in the recess such that the ring is substantially flush to an exterior surface of the housing.

12. The device of claim 1, further including a plurality of indentations positioned in the ring wherein the indentations are configured for preventing slippage of digits of the respective hand of the user positioned upon the ring for rotating the ring relative to the housing.

13. The device of claim 7, further including the power module comprising a battery.

14. The device of claim 13, further comprising:

the battery being rechargeable; and a connector coupled to the housing, the connector being operationally coupled to the battery wherein the connector is configured for inserting a plug of a charging cord for recharging the battery.

15. A personal propulsion device comprising:

a pair of propulsion units, each propulsion unit comprising a power module, a motor, and a propeller, the power module comprising a battery, the battery being rechargeable, the motor being operationally coupled to the power module and the propeller such that the motor is positioned for selectively rotating the propeller for imparting a force on water wherein each propulsion unit is configured for grasping in a respective hand of a user positioned on a floatation device positioning the user for submerging the propulsion unit in a body of water such that the floatation device is motivated across a surface of the body of water, each propulsion unit comprising:

a housing defining an interior space, the power module and the motor being coupled to the housing and positioned in the interior space, the propeller being rotationally coupled to the housing and positioned in the interior space proximate to a first end of the housing, the first end being open, a plurality of apertures positioned in the housing between the propeller and a second end of the housing wherein the apertures are configured for inflow of water into the interior space positioning the propeller for expelling the water through the first end of the housing for imparting the force on the water for motivating the floatation device across the surface of the body of water, a wall coupled to the housing and positioned in the interior space defining a chamber, the wall being positioned proximate to the plurality of apertures such that water entering the interior space through the apertures is directed along the wall to the propeller, the power module being substantially centrally positioned in the chamber, the motor being positioned in the chamber proximate to the wall, a connector coupled to the housing, the connector being operationally coupled to the battery wherein the connector is configured for inserting a plug of a charging cord for recharging the battery, the connector comprising a Universal Serial Bus port, and a stopper hingedly coupled to the housing proximate to the Universal Serial Bus port, the stopper being complementary to the Universal Serial Bus port such that the stopper is positioned for selectively inserting into the Universal Serial Bus port wherein the stopper is configured for sealing the Universal Serial Bus port for preventing entry of water through the Universal Serial Bus port into the chamber.

16. The device of claim 1, further including a pair of straps, each strap having opposing ends coupled to a respective housing defining a loop wherein the loop is configured for inserting the respective hand of the user such that the housing is loopedly coupled to the respective hand of the user.

17. A personal propulsion device comprising:

a pair of propulsion units, each propulsion unit comprising a power module, a motor, and a propeller, the motor being operationally coupled to the power module and the propeller such that the motor is positioned for selectively rotating the propeller for imparting a force on water wherein each propulsion unit is configured for grasping in a respective hand of a user positioned on a floatation device positioning the user for submerging the propulsion unit in a body of water such that the floatation device is motivated across a surface of the body of water, each propulsion unit comprising:

a housing defining an interior space, the power module and the motor being coupled to the housing and positioned in the interior space, the propeller being rotationally coupled to the housing and positioned in the interior space proximate to a first end of the housing, the first end being open, the housing being cylindrically shaped, the power module comprising a battery, the battery being rechargeable, a plurality of apertures positioned in the housing between the propeller and a second end of the housing wherein the apertures are configured for inflow of water into the interior space positioning the propeller for expelling the water through the first end of the housing for imparting the force on the water for motivating the floatation device across the surface of the body of water, the apertures being ovally shaped, the plurality of apertures comprising from three to six apertures, the plurality of apertures comprising four apertures, a grate coupled to the housing and extending over the first end of the housing wherein the grate is configured for shielding the propeller, a wall coupled to the housing and positioned in the interior space defining a chamber, the wall being positioned proximate to the plurality of apertures such that water entering the interior space through the apertures is directed along the wall to the propeller, the power module being substantially centrally positioned in the chamber, the motor being positioned in the chamber proximate to the wall, the chamber being watertight such that the power module and the motor are protected from water damage, the motor being magnetically coupled to the propeller, a controller coupled to the housing, the controller being operationally coupled to the motor such that the controller is positioned for controlling a rotational speed of the propeller for adjusting the force imparted on the water by the propeller, the controller comprising a ring rotationally coupled to the housing proximate to the second end wherein the ring is configured being selectively rotated relative to the housing for controlling the rotational speed of the propeller for adjusting the force imparted on the water by the propeller, a switch coupled to the second end of the housing, the switch being operationally coupled to the motor and the power module wherein the switch is configured for being selectively switched for operationally coupling the power module to the motor, the switch comprising a button, the button being depressible wherein the button is configured for being depressed a first time for operationally coupling the power module to the motor and for being depressed a second time for decoupling the power module from the motor, a recess positioned in the housing proximate to the second end, the ring being positioned in the recess such that the ring is substantially flush to an exterior surface of the housing, a plurality of indentations positioned in the ring wherein the indentations are configured for preventing slippage of digits of the respective hand of the user positioned upon the ring for rotating the ring relative to the housing, a connector coupled to the housing, the connector being operationally coupled to the battery wherein the connector is configured for inserting a plug of a charging cord for recharging the battery, the connector comprising a Universal Serial Bus port, and a stopper hingedly coupled to the housing proximate to the Universal Serial Bus port, the stopper being complementary to the Universal Serial Bus port such that the stopper is positioned for selectively inserting into the Universal Serial Bus port wherein the stopper is configured for sealing the Universal Serial Bus port for preventing entry of water through the Universal Serial Bus port into the chamber; and a pair of straps, each strap having opposing ends coupled to a respective housing defining a loop wherein the loop is configured for inserting the respective hand of the user such that the housing is loopedly coupled to the respective hand of the user.

* * * * *